US010612188B2

(12) United States Patent
Hu et al.

(10) Patent No.: US 10,612,188 B2
(45) Date of Patent: Apr. 7, 2020

(54) ALKOXYLATED POLYETHYLENEIMINE HYDROPHILICALLY-MODIFIED FIBERS

(71) Applicant: BASF SE, Ludwigshafen (DE)

(72) Inventors: Qin Qin Hu, Shanghai (CN); Laszlo Szarvas, Shanghai (CN); Si Jun Zhu, Shanghai (CN)

(73) Assignee: BASF SE, Ludwigshafen (DE)

( * ) Notice: Subject to any disclaimer, the term of this patent is extended or adjusted under 35 U.S.C. 154(b) by 75 days.

(21) Appl. No.: 15/547,821

(22) PCT Filed: Feb. 5, 2016

(86) PCT No.: PCT/EP2016/052515

§ 371 (c)(1),
(2) Date: Aug. 1, 2017

(87) PCT Pub. No.: WO2016/124743

PCT Pub. Date: Aug. 11, 2016

(65) Prior Publication Data

US 2018/0016742 A1 Jan. 18, 2018

Related U.S. Application Data

(63) Continuation of application No. PCT/CN2015/072396, filed on Feb. 6, 2015.

(51) Int. Cl.
*D06M 15/61* (2006.01)
*D06M 15/53* (2006.01)

(52) U.S. Cl.
CPC ..... *D06M 15/61* (2013.01); *D06M 15/53* (2013.01)

(58) Field of Classification Search
CPC ..... D06M 15/61
See application file for complete search history.

(56) References Cited

U.S. PATENT DOCUMENTS

| | | | | |
|---|---|---|---|---|
| 3,794,464 | A | 2/1974 | Lofquist et al. | |
| 3,968,315 | A | 7/1976 | Hochreuter | |
| 6,514,932 | B1 * | 2/2003 | Hubesch | C11D 3/0015 510/517 |
| 7,074,750 | B2 * | 7/2006 | Hamers | D06M 23/08 510/276 |

FOREIGN PATENT DOCUMENTS

| | | | |
|---|---|---|---|
| CN | 103321054 | A | 9/2013 |
| CN | 103469584 | A | 12/2013 |
| GB | 1078303 | A | 8/1967 |
| WO | WO-2010/135140 | A2 | 11/2010 |

OTHER PUBLICATIONS

Ateiza, O.J., et al., "Surface Treatment of Poly(ethylene terephthalate) Fabric with Polyethyleneimine." *Chinese Journal of Polymer Science*, 1997, vol. 15, No. pp. 311-318.
International Search Report for Patent Application No. PCT/EP2016/052515, dated May 9, 2016.

* cited by examiner

*Primary Examiner* — Robert D Harlan
(74) *Attorney, Agent, or Firm* — Marshall, Gerstein & Borun LLP

(57) ABSTRACT

The invention relates to an alkoxylated polyethyleneimine hydrophilically-modified fiber, wherein the alkoxylated polyethyleneimine has a weight average molecular weight of 600 to 25,000 and contains 1 to 40 alkylene oxide units per nitrogen atom. The invention also relates to a method of improving hydrophilicity of fiber comprising impregnating the fiber with an aqueous solution containing an alkoxylated polyethyleneimine, wherein the alkoxylated polyethyleneimine has a weight average molecular weight of 600 to 25,000 and contains 1 to 40 alkylene oxide units per nitrogen atom. The invention also relates to use of the alkoxylated polyethyleneimine in improving hydrophilicity of fiber.

14 Claims, No Drawings

ALKOXYLATED POLYETHYLENEIMINE HYDROPHILICALLY-MODIFIED FIBERS

CROSS-REFERENCE TO RELATED APPLICATIONS

This application is the U.S. National Stage application of International Patent Application No. PCT/EP2016/052515, filed Feb. 5, 2016, which claims the benefit of International Patent Application No. PCT/CN2015/072396, filed Feb. 6, 2015.

FIELD OF THE INVENTION

The invention relates to an alkoxylated polyethyleneimine hydrophilically-modified fiber and a method of improving hydrophilicity of fiber using alkoxylated polyethyleneimine. The invention also relates to use of alkoxylated polyethyleneimine in improving hydrophilicity of fibers.

DESCRIPTION OF RELATED ARTS

The hydrophobic nature of some fibers such as polyester fibers results in a relatively low level of comfort, as moisture from skin cannot be absorbed sufficiently by the hydrophobic fibers. This has restricted the use of hydrophobic fibers in the textile application such as sportswear, underwear and bedding. Additionally, the hydrophobic fibers can exhibit electrostatic problems.

GB 1,078,303 discloses an anti-electrostatic finishing of synthetic fibers such as polyacrylonitrile and polyamides fibers. According to GB 1,078,303, the anti-electrostatic finishing process comprises impregnating fibers with an aqueous preparation containing polyethyleneimine polyoxyalkylation product or salts thereof.

U.S. Pat. No. 3,968,315 discloses a method of treating materials such as polyamide, polyester, or polyacrylonitrile by using alkoxylated polyalkylene polyamines, to reduce the tendency of accumulating electrostatic charge during finishing.

A branched polyethyleneimine (BPEI) is applied to polyester fabric through pad-dry-heat treatment to improve its surface moisture absorption property, which is intended to protect materials against accumulation of electrostatic charge (vide Chinese Journal of Polymer Science, 1997, Vol. 15, No. 4, O. J. ATEIZA, etc). However, this paper does not mention a non-acceptable fabric yellowing problem in drying process when using this unmodified polyethyleneimine.

U.S. Pat. No. 3,794,464 discloses an alkoxylated aliphatic polyethyleneimine to inhibit ozone fading of dyed polyamides, wherein said alkoxylated aliphatic polyethyleneimine has a molecular weight of about 100 to about 60,000.

CN103469584A discloses a method of producing anti-electrostatic cashmere sweater by finishing cashmere sweater with an anti-electrostatic finishing agent containing polyethyleneimine.

However, the prior arts do not mention to improve the hydrophilicity of fibers by using alkoxylated polyalkyleneimine.

CN103321054A discloses a fluffiness finishing agent for polyester fibers, wherein said finishing agent is a polyester polyether silicone oil block copolymer. The finished fibers are very fluffy and soft, and at the same time can improve the anti-electrostatic property and hydrophilicity of polyester fibers.

However, there is still need to improve the hydrophilicity of hydrophobic fabric, and/or achieve a relatively high level of comfort and/or better anti-electrostatic property.

SUMMARY OF THE INVENTION

For the purpose of the invention, the invention provides an alkoxylated polyethyleneimine hydrophilically-modified fiber, wherein the alkoxylated polyethyleneimine has a weight average molecular weight of 600 to 25,000 and contains 1 to 40 of alkylene oxide unit per nitrogen atom.

The invention also provides a method of improving hydrophilicity of fiber comprising impregnating the fiber with an aqueous solution containing an alkoxylated polyethyleneimine, wherein the alkoxylated polyethyleneimine has a weight average molecular weight of 600 to 25,000 and contains 1 to 40 of alkylene oxide unit per nitrogen atom.

The invention also provides use of the alkoxylated polyethyleneimine in improving hydrophilicity of fiber.

It is found that alkoxylated polyalkyleneimine can improve the hydrophilicity of hydrophobic fabric greatly, and/or achieve a relatively high level of comfort and/or good anti-electrostatic property.

EMBODIMENTS OF THE INVENTION

In one embodiment of the invention, the invention provides an alkoxylated polyethyleneimine hydrophilically-modified fiber, wherein the alkoxylated polyethyleneimine has a weight average molecular weight of 600 to 25,000 and contains 1 to 40 of alkylene oxide unit per nitrogen atom.

Generally, the fiber can be any hydrophobic fiber, for example the fiber can comprise polyamide, polyester, cotton fabric, and combination thereof.

In one preferred embodiment of the invention, the alkoxylated polyethyleneimine has a weight average molecular weight of 2,000 to 20,000, preferably 5,000 to 15,000.

In one embodiment of the invention, the alkoxylated polyethyleneimine contains 10 to 30, preferably 18 to 22 alkylene oxide units per nitrogen atom.

In one preferred embodiment of the invention, the alkoxylated polyethyleneimine can comprise ethoxylated polyethyleneimine, propoxylated polyethyleneimine, butoxylated polyethyleneimine, and combination thereof.

In one embodiment of the invention, said alkoxylated polyethyleneimine is prepared according to conventional methods in the art. For example, aziridine is cationically polymerized to form polyethyleneimines (PEIs) in the presence of acidic catalysts, and then the alkoxylation of PEIs is carried out by using ethylene oxide, propylene oxide, butylenes oxide and mixture thereof, as described in Houben-Weyl, Methoden der organischen Chemie, 4. Ed., Vol. 14/2, p. 440 ff. (1963) and Vol. E 20, p. 1367 f. (1987).

It is known that amino modified silicone oil emulsion is widely used as softener on cotton fabric. But amino modified silicone oil emulsion will reduce hydrophilic property of cotton fabric. It is found that the alkoxylated polyethyleneimine can be used as a hydrophilic softener to maintain or improve the hydrophilicity of cotton fabric, when it is treated with amino modified silicone oil emulsion.

In one embodiment of the invention, the invention also provides a method of improving hydrophilicity of fiber comprising impregnating the fiber with an aqueous solution containing an alkoxylated polyethyleneimine, wherein the alkoxylated polyethyleneimine has a weight average molecular weight of 600 to 25,000 and contains 1 to 40 of alkylene oxide unit per nitrogen atom.

Particularly, the aqueous solution can comprise 1-8 g/L, preferably 2.5-6 g/L alkoxylated polyethyleneimine based on the total weight of the aqueous solution.

In one embodiment of the invention, the invention also provides use of said alkoxylated polyethyleneimine in improving hydrophilicity of fiber.

The water drop absorption time (drip diffusion time) is measured according to GB/T 21665.1-2008.

Surface resistivity of fabric is measured according to EN 1149-1:2006.

Fabric softness is classified into grade 0 to grade 5 by hand feeling. Grade 5 is the best, Grade 0 is the worst.

Wicking height is measured according to GB/T 21665, 1-2008.

All percentages are mentioned by weight unless otherwise indicated.

EXAMPLES

The present invention is now further illustrated by reference to the following examples, however, the examples are used for the purpose of explanation and not intended to limit the scopes of the invention.

Example 1

Prepare an aqueous solution containing Sokalan HP20 (available from BASF Co., Ltd, one kind of ethoxylated polyethyleneimine) with a concentration of 2.5 g/L (solid content), then dip the PET fabric into the aqueous solution and use the padding machine (Rapid PB1) to pad, about 100-120 wt % of the aqueous solution remains on the fabric based on the weight of the PET fabric, then cure the fabric on the Stenter (Mathis, LTE 49200) at a temperature of 170° C. for 2 min.

The resulting fabric is divided into 3 batches. First batch fabric is placed at a constant temperature of 21° C. and relative humidity of 65% for 12 hours, and then water drop absorption time (drip diffusion time) is measured according to GB/T 21665, 1-2008.

The Second batch fabric is subjected to washing and drying cycle for five times according to AATCC 135-2010 (Standard laundry machine Whirlpool, CS20057683 and drying machine Whirlpool, E391). After 5 times of washing and drying cycle, the fabric is placed at a constant temperature of 21° C. and relative humidity of 65% for 12 hours, and then water drop absorption time (drip diffusion time) is measured according to GB/T 21665, 1-2008.

The third batch fabric is placed at a constant temperature of 23±1° C. and relative humidity of 25±5% for 24 hours, and then anti-electrostatic property is measured according to EN 1149-1:2006.

Comparative Example 1

The procedure of comparative example 1 is the same as that of example 1 except that PET-PEG block copolymer (DP9992 from Duplus) is used instead of Sokalan HP20.

Comparative Example 2 (Blank Test)

The procedure of comparative example 2 is the same as that of example 1 except that only pure water is used without adding Sokalan HP20.

Comparative Example 3

The procedure of comparative example 3 is the same as that of example 1 except that polyethyleneimine (Lupasol P from BASF Co., Ltd) is used instead of Sokalan HP20 (one kind of ethoxylated polyethyleneimine).

It is found that yellowing problem is too serious to be accepted in the industry when using this non-ethoxylated polyethyleneimine.

The measured results for example 1, comparative example 1 and comparative example 2 are listed in table 1.

TABLE 1

| | Hydrophilicity (drip diffusion time) | | Antistatic property |
|---|---|---|---|
| Sample | Before washing | After 5th washing | Surface Resistance (ohm) |
| Example 1 | <1 second | <2 second | $9.0 * 10^{10}$ |
| Comparative example 1 | <1 second | <2 second | $2.0 * 10^{11}$ |
| Comparative example 2 | >5 second | >5 second | $2.1 * 10^{12}$ |

Table 1 shows that the hydrophilicity and antistatic properties of polyester fabric have been significantly improved by treatment of the aqueous solution containing Sokalan HP20 according to the present invention. The hydrophilicity of polyester fabric has been remarkably improved by treatment of the aqueous solution containing PET-PEG block copolymer, while its antistatic property is much less than that of the present invention.

Example 2

Prepare an aqueous solution containing 1 g/L amino modified silicone oil emulsion (TF-452 from Transfar) (solid content) and 3 g/L Sokalan HP20 (solid content), then dip knitted cotton fabric into the aqueous solution and use the padding machine (Rapid PB1) to pad, about 70 wt % of the aqueous solution remains on the fabric based on the weight of the knitted cotton fabric, then cure the fabric on the Stenter (Mathis, LTE 49200) at a temperature of 160° C. for 2 min.

The resulting fabric is divided into 2 batches. One batch is placed at a constant temperature of 21° C. and relative humidity of 65% for 12 hours, and then softness is measured by hand feeling and water drop absorption time (drip diffusion time) is measured by GB/T 21665, 1-2008.

Another batch of fabric is subjected to washing and drying cycle for five times according to AATCC 135-2010 (Standard laundry machine Whirlpool, CS20057683 and drying machine Whirlpool, E391). After 5 times of washing and drying cycle, the fabric is placed at a constant temperature of 21° C. and relative humidity of 65% for 12 hours, and then softness is measured by hand feeling and water drop absorption time (drip diffusion time) is measured by GB/T 21665, 1-2008.

Comparative Example 4

The procedure of comparative example 4 is the same as that of example 2 except that an aqueous solution containing 1 g/L amino modified silicone oil emulsion (solid content) and 3 g/L hydrophilic silicone oil emulsion (solid content) (TF-405B from Transfar, one kind of Silicone-PEG copolymer) is used.

Comparative Example 5

The procedure of comparative example 5 is the same as that of example 2 except that an aqueous solution containing 4 g/L amino modified silicone oil emulsion (TF-452 from Transfar) (solid content) is used.

Comparative Example 6 (Blank Test)

The procedure of comparative example 6 is the same as that of example 2 except that only pure water is used.

The measured results for example 2, comparative example 4, comparative example 5 and comparative example 6 are listed in table 2.

TABLE 2

| Sample | Hand feeling Before washing | Wicking height Before washing/5 min | Hand feeling After $5^{th}$ washing | Wicking height After $5^{th}$ washing/5 min |
|---|---|---|---|---|
| Comparative example 4 | 3 | 8 cm | 3 | 4.5 cm |
| Example 2 | 4 | 8 cm | 3 | 6 cm |
| Comparative example 5 | 5 | 5.3 cm | 4 | 0.5 cm |
| Comparative example 6 | 0 | 12 cm | 1 | 13 cm |

Table 2 shows that Sokalan HP20 could remarkably maintain hydrophilicity of cotton fabric when cotton fabric is treated with amino silicone oil emulsion and Sokalan HP20. In addition, after $5^{th}$ washing, the fabric hydrophilicity after treatment with amino modified silicone oil emulsion and Sokalan HP20 according to the present invention is better than that by treatment with amino modified silicone oil emulsion and silicone-PEG copolymer. Furthermore, before washing, the fabric hand feeling after treatment with amino modified silicone oil emulsion and Sokalan HP20 according to the present invention is better than that by treatment with amino modified silicone oil emulsion and silicone-PEG copolymer. Furthermore, the fabric hydrophilicity after treatment with amino modified silicone oil emulsion and Sokalan HP20 according to the present invention is much better than that by treatment with only amino modified silicone oil emulsion, especially after $5^{th}$ washing.

It will be apparent to those skilled in the art that various modifications and variations can be made in the present invention without departing from the scope or spirit of the invention. Thus, it is intended that the present invention cover such modifications and variations as come within the scope of the appended claims and their equivalents.

The invention claimed is:

1. An alkoxylated polyethyleneimine hydrophilically-modified fiber, wherein the alkoxylated polyethyleneimine has a weight average molecular weight of 2,000 to 20,000 and contains 10 to 40 alkylene oxide units per nitrogen atom.

2. The alkoxylated polyethyleneimine hydrophilically-modified fiber according to claim 1, wherein the fiber comprises at least one of a polyamide, a polyester, a cotton fabric, and combinations thereof.

3. The alkoxylated polyethyleneimine hydrophilically-modified fiber according to claim 1, wherein the alkoxylated polyethyleneimine contains 10 to 30 alkylene oxide units per nitrogen atom.

4. The alkoxylated polyethyleneimine hydrophilically-modified fiber according to claim 1, wherein the alkoxylated polyethyleneimine comprises ethoxylated polyethyleneimine, propoxylated polyethyleneimine, butoxylated polyethyleneimine, and combination thereof.

5. A method of improving hydrophilicity of fiber comprising impregnating the fiber with an aqueous solution containing an alkoxylated polyethyleneimine, wherein the alkoxylated polyethyleneimine has a weight average molecular weight of 2,000 to 20,000 and contains 10 to 40 alkylene oxide units per nitrogen atom.

6. The method according to claim 5, wherein the alkoxylated polyethyleneimine contains 10 to 30 alkylene oxide units per nitrogen atom.

7. The method according to claim 5, wherein the fiber comprises at least one of a polyamide, a polyester, a cotton fabric, and combinations thereof.

8. The method according to claim 5, wherein the aqueous solution comprises 1-8 g/L alkoxylated polyethyleneimine based on the total weight of the aqueous solution.

9. The alkoxylated polyethyleneimine hydrophilically-modified fiber according to claim 1, wherein the alkoxylated polyethyleneimine has a weight average molecular weight of 5,000 to 15,000.

10. The alkoxylated polyethyleneimine hydrophilically-modified fiber according to claim 1, wherein the alkoxylated polyethyleneimine contains 18 to 22 alkylene oxide units per nitrogen atom.

11. The method according to claim 5, wherein the alkoxylated polyethyleneimine comprises ethoxylated polyethyleneimine, propoxylated polyethyleneimine, butoxylated polyethyleneimine, and combination thereof.

12. The method according to claim 5, wherein the alkoxylated polyethyleneimine has a weight average molecular weight of 5,000 to 15,000.

13. The method according to claim 5, wherein the alkoxylated polyethyleneimine contains 18 to 22 alkylene oxide units per nitrogen atom.

14. The method according to claim 5, wherein the aqueous solution comprises 2.5-6 g/L alkoxylated polyethyleneimine based on the total weight of the aqueous solution.

* * * * *